US008038436B2

(12) United States Patent
Rogers, Jr. et al.

(10) Patent No.: US 8,038,436 B2
(45) Date of Patent: Oct. 18, 2011

(54) TEXTILE CURING OVEN WITH ACTIVE COOLING

(75) Inventors: James H. Rogers, Jr., Dalton, GA (US); Billy F. McGowan, Chattanooga, TN (US)

(73) Assignee: ADD BAC, Inc., Dalton, GA (US)

( * ) Notice: Subject to any disclaimer, the term of this patent is extended or adjusted under 35 U.S.C. 154(b) by 341 days.

(21) Appl. No.: 12/437,720

(22) Filed: May 8, 2009

(65) Prior Publication Data

US 2009/0220905 A1 Sep. 3, 2009

Related U.S. Application Data

(63) Continuation of application No. 11/672,583, filed on Feb. 8, 2007, now abandoned.

(51) Int. Cl.
*F27B 9/28* (2006.01)

(52) U.S. Cl. ..... 432/8; 432/59; 34/464

(58) Field of Classification Search ..... 432/8, 59, 432/121, 122; 34/362, 366, 391, 393, 394, 34/395, 451, 464

See application file for complete search history.

(56) References Cited

U.S. PATENT DOCUMENTS

| | | | | | |
|---|---|---|---|---|---|
| 2,952,078 | A * | 9/1960 | Litzler | 34/68 |
| 4,217,090 | A * | 8/1980 | Whike et al. | 432/8 |
| 4,227,317 | A * | 10/1980 | Fleissner | 34/636 |
| 4,588,378 | A * | 5/1986 | Yamamoto et al. | 432/59 |
| 5,172,849 | A * | 12/1992 | Barten et al. | 228/18 |
| 5,201,132 | A * | 4/1993 | Jacob | 34/393 |
| 5,881,476 | A * | 3/1999 | Strobush et al. | 34/451 |
| 6,237,248 | B1 * | 5/2001 | Mayer | 34/420 |
| 6,833,533 | B1 * | 12/2004 | Wolfe et al. | 219/400 |
| 7,296,995 | B2 * | 11/2007 | Niklaus et al. | 432/59 |
| 2006/0162891 | A1 * | 7/2006 | Sakari | 162/207 |

* cited by examiner

*Primary Examiner* — Gregory A Wilson
(74) *Attorney, Agent, or Firm* — Samuel Digirolamo; Husch Blackwell LLP

(57) ABSTRACT

An oven for bonding adhesives to the back surface of a textile article includes a housing with a transport frame for passing the textile article through a curing chamber within the housing. The oven also has an air source and a duct system that delivers an airflow into a cool zone on the opposite, pile surface side of the textile article. The airflow has a lower temperature than the elevated temperature of the curing chamber and is supplied to the cool zone in sufficient amounts such that the pressure in the cool zone exceeds the ambient pressure in the curing chamber.

20 Claims, 7 Drawing Sheets

TEXTILE CURING OVEN WITH ACTIVE COOLING

CROSS-REFERENCE TO RELATED APPLICATIONS

This application is a continuation of U.S. patent application Ser. No. 11/672,583, filed Feb. 8, 2007 now abandoned, which is hereby incorporated by reference.

FEDERALLY SPONSORED RESEARCH

Not Applicable.

APPENDIX

Not Applicable.

BACKGROUND OF THE INVENTION

1. Field of the Invention

This invention relates generally to the manufacture of textile articles, such as carpet and synthetic turf products. More specifically, the invention relates to an oven used to cure adhesives to the back of textile articles.

2. Related Art

It is well known to prepare textile articles having a pile surface, such the tufted side of a carpet and synthetic turf, by binding natural or synthetic fibers to a primary backing material by the means of a thermosetting adhesive. Secondary, tertiary and further backing materials may also be utilized and may be similarly bound to prior backing materials, to the fibers, or to both by means of a thermosetting adhesive. To bind the backing material to fibers, to other layers of backing material, or to both, the back surface of article is coated with a layer of thermosetting adhesive. The thermosetting adhesive is then heated to a sufficiently high temperature so that it achieves a liquid or plastic state and penetrates the interstices of the fibers, the respective layer(s) of backing material, or both. An effective method for heating the thermosetting adhesive is to pass the textile article, coated with the thermosetting adhesive, through an oven. However, the thermoplastic fibers and backing materials have softening temperatures in the same general range as the temperatures required to heat the thermosetting adhesives. Typically, the softening point of thermosetting adhesives used to anneal fibers to the primary backing is between approximately 180° F. and 250° F. The softening point of thermoplastic fibers used for artificial turfs is typically less than 176° F. (80° C.). For example, Thiolon™ polyethylene fiber, a preferred fiber used in artificial turfs, softens at temperatures greater than 150° F. (65.5° C.) and fiber shrinkage is 1.2% at 158° F. (70° C.). Thus, the manufacturer recommends that that coatings be applied at the lowest possible temperature and Thiolon™ fibers not be exposed to temperatures in excess of 194° F. (90° C.).

Tunnel ovens, such as those described in U.S. Pat. Nos. 6,944,968, 6,121,166 6,180,166, 5,045,375, and 4,390,585, are particularly suitable for bonding a thermosetting adhesive to a textile article, and such ovens are commercially available from various manufacturers such as Schott & Meissner, FECO and Glenro. Transport assemblies for transporting articles through a tunnel oven are well known in the art and commercially available, preferably having continuous loop flexible chain linkage means for rotational movement of parallel, laterally extending rollers, such as a conveyor assembly. The transport assemblies also include well known devices to support and secure the textile. The support means preferably comprise stenter or tenter frames, such as those described in U.S. Pat. No. 4,788,756, or other similar support means movably connected to the transport assembly.

Multi-pass tunnel ovens that have transport and support assemblies and allow an article to pass through the oven more than once, in a loop fashion, are also well known in the art and are commercially available. Such multiple-pass tunnel ovens permit extended heating times without requiring longer oven housings. Due to the benefits of a relatively shorter length and an extended heating time, a multi-pass tunnel oven having upper and lower transport means and support means disposed to permit an article to pass through the oven twice in a loop fashion, is preferable over other oven configurations.

Various means may be used to provide heat in such ovens, including microwave energy, radiant heat (as described in U.S. Pat. No. 3,150,024), convection heat (as described in U.S. Pat. No. 4,604,491), hot air impingement, heated platens (as described in U.S. Pat. No. 4,174,991), ultrasound energy (as described in U.S. Pat. No. 6,720,058), and heated drums or rollers (as described in U.S. Pat. App. Pub. 2006/001389 and U.S. Pat. Nos. 4,652,322, 3,673,034 and 2,891,279). Heat may be generated by gas burner, steam, hot water, electrical heating elements, infrared heat lamps, ultrasound generators, microwave generators, infrared radiation generators or various other heat generating means that will be apparent to those possessing ordinary skill in the art. Air impingement tunnel ovens that are heated by gas burners are particularly suitable for purposes of the present invention.

It is often desirable to use combinations of fibers and thermosetting adhesives, where the temperature necessary to effect a sufficiently liquid or plastic state of the thermosetting adhesive is higher than the temperature at which the fibers will burn, soften, shrink or otherwise be damaged. It is particularly common in the manufacture of artificial turf for fibers to shrink or curl, resulting in a product that is lower in quality and may be less functional, less aesthetic, or both. Furthermore, to compensate for anticipated shrinkage, fibers that are longer than the desired post-heated length must be used in the pre-heated article, thereby increasing the cost and the weight of the product.

To minimize the effects of heating the fibers, prior art ovens and heating systems have employed split heat zones within the oven. In certain heating systems, the article passes sequentially through one or more heated zones and then sequentially passes through one or more separate cooled zones. However, such systems do not permit simultaneous heating of the thermosetting adhesive on the back surface with the cooling of heat-sensitive fibers on the pile surface and subsequent cooling is not generally effective to prevent or reverse the shrinkage, curling and other undesired effects on the fibers that occur in the heated zones.

Some prior art split zone ovens allow for separate heating of a top zone and a bottom zone within the oven, such as in the CTS/Gyson True Zone oven, so that the thermosetting adhesive covered back surface of the textile article may be heated to a higher temperature than the more temperature sensitive pile surface of the article. However, prior art ovens merely recirculate the air in both of the respective zones so there is no active cooling with a positive pressure differential from the cooler zone to the hotter zone nor are there exhaust ports for directly venting the cooling air without recirculation. In yet another form of a prior art split zone oven, the article passes through the oven with only the back surface exposed directly to the heat source, such as with a single air impingement oven. In such prior art split zone ovens, the heat from the higher temperature zone may leak or flow into the less heated or unheated zone at various locations along the transport frame, thereby raising the localized temperature of the pile surface at these locations and causing shrinkage and warping of the fibers.

Physical barriers have been developed in an attempt to substantially separate the heated and lesser heated or unheated zones, and to deter hot air leakage or flow into areas in which the tufted surface passes. Current barriers include metal plates or heat-resistance cloths that run the length of the oven in the same plane as the transport assembly, and are positioned between the oven walls and the support or transport system. However, physical barriers alone do not sufficiently prevent hot air from leaking into less heated or unheated zones, and this leakage can damage the pile side of the textile, particularly along the edges as well as other localized heating regions that may also damage the pile surface. Additionally, heat-resistant cloths may become worn and develop tears further diminishing the barrier function. Thus, known means to separate heated from less heated or unheated zones within ovens are not completely effective in maintaining the tufted surface at a sufficiently low temperature and eliminating shrinkage, curling, and other undesired effects on heat-sensitive fibers.

To date, there is no known oven that permits active cooling of the pile surface of a textile article while simultaneously heating the thermosetting adhesive covered back surface of such article. Without the present invention, current ovens can shrink polyethylene fibers by approximately ¼" for a pile that is about 2¼", resulting in more than 5% shrinkage. Thus, there is a need for an oven that has the capability to heat the thermosetting adhesive to a sufficiently high temperature so that the adhesive softens or melts and flows into the interstices of the fibers, layer(s) of backing material, or both, while simultaneously protecting the pile surface of the textile article so as to reduce or eliminate warping, shrinkage and any other undesired alteration of the fibers.

BRIEF SUMMARY OF THE INVENTION

It is in view of the above problems that the present invention was developed. The present invention comprises an apparatus for simultaneously heating and cooling opposite surfaces of an object. In one embodiment of the invention, the apparatus comprises an oven with a curing chamber at an elevated temperature and an air source that supplies lower temperature airflow into the housing of the oven to actively cool the pile surface of the textile article as it is transported through the oven. The lower temperature airflow is at a higher pressure than the air in the curing chamber, thereby preventing the elevated temperature from leaking to the pile side of the textile article, and is vented out of the oven after cooling the textile article so that there is no recirculation of the lower temperature airflow.

These and other aspects, features and advantages of the present invention will be apparent to those possessing ordinary skill in the art from the following detailed description and the drawings. These aspects of the invention are merely illustrative of the numerous objects and aspects associated with the present invention and should not be deemed to limit the invention disclosed herein. Although methods and materials similar or equivalent to those described herein may be used in the practice of the present invention, suitable methods and materials are described below. The materials, methods and examples described herein are illustrative only and are not intended to be limiting in any manner.

DETAILED DESCRIPTION OF THE INVENTION

Figure 1:
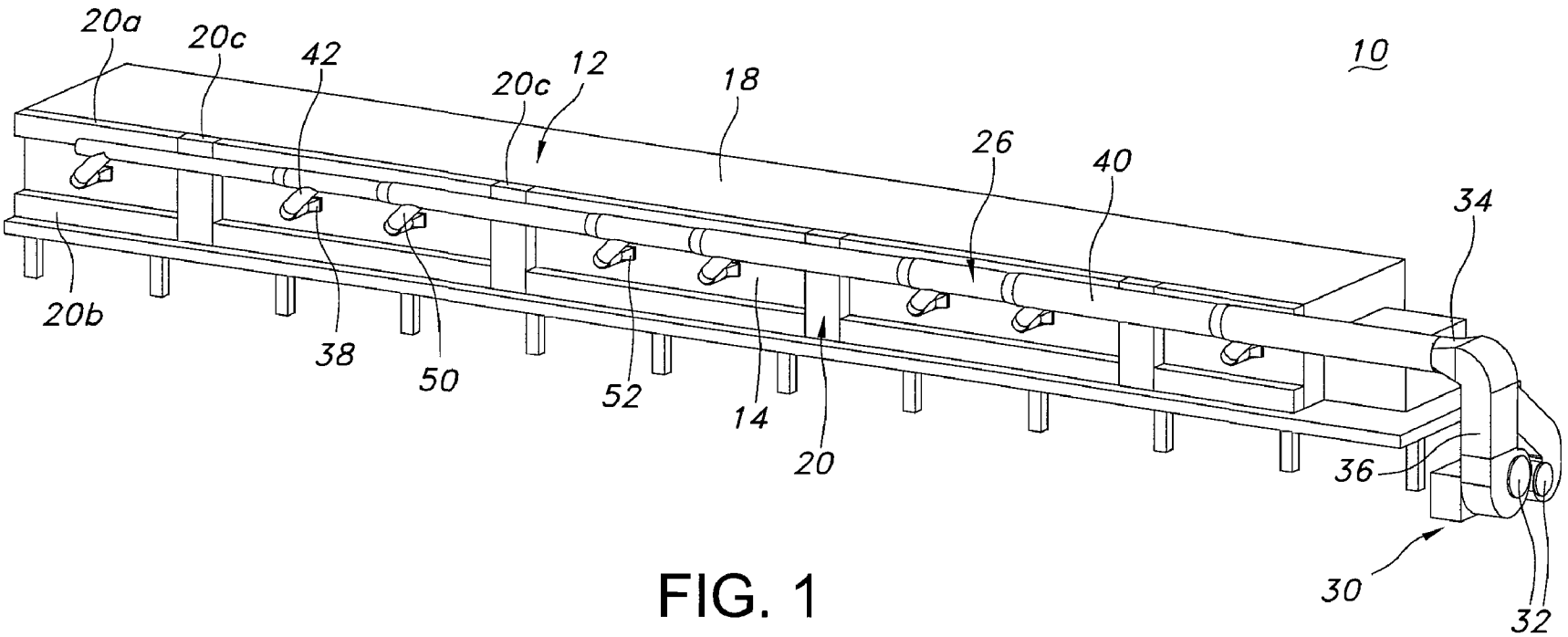
FIG. 1 illustrates a perspective view of the oven.

As illustrated in FIGS. 1-4 and 8, a curing oven 10 has a housing 12 with side walls 14, a floor 16 and a ceiling 18 with heat ducts 20 spaced along the length of the housing 12. As in currently known curing ovens, the heat ducts 20 supply hot air from the burners (not shown) to the curing chamber 22 within the oven's housing 12, thereby producing the elevated temperatures 24 that are necessary to melt the thermosetting adhesives (not shown) on the back surface 100 of the textile article 200. The present invention uses a duct system 26 to supply a cooler temperature airflow 28 (i.e., ambient or chilled air) from an air source 30 to the opposing pile surface 110 of the textile article 200 as it is being transported through the oven 10 and the thermosetting adhesives on the back surface 100 are simultaneously being melted. In the preferred embodiment of the invention, the air source 30 is a blower 32 in the form of an electric motor driven rotary fan. It will be appreciated that other types of fans could be used for the air source, such as centrifugal fans and squirrel-cage fans, and that a refrigerated source of air could also be provided. Preferably, the air source 30 does not use any type of a burner or other heating unit because the temperature of the cooler temperature airflow 28 should not be raised to the elevated temperatures 24 used for melting the thermosetting adhesives.

The air source 30 may also have additional blowers 32, of the same or a different air moving capacity, as may be desirable to supply sufficient air to a particular oven. The number and type of air source 30 units may depend on the size of the oven 10 which can vary in length and width. The air source 30 is connected to the duct system 26 through the manifold intake 34, and multiple blowers 32 can be connected to the manifold intake 34 through a collecting plenum 36. The blowers 32 may also include a compressor or other air cycle system to cool the air below ambient temperature.

The cooler temperature airflow 28 enters the oven 10 through the receiving ports 38 that are preferably spaced along the side wall 14 of the housing 12. The cooler temperature airflow 28 travels to the receiving ports 38 from the air source 30 via the manifold intake 34 which connects to the manifold duct 40. The manifold duct 40 extends substantially along the length of the oven housing 12, having discharge ports 42 periodically spaced along the length of the manifold duct 40. Preferably, the diameter of the manifold gradually decreases as the manifold duct 40 extends distally from the manifold intake 34, thereby facilitating a relatively constant air pressure throughout the length of the manifold duct 40. The spacing of the discharge ports 42 along the manifold duct 40 respectively correspond with the receiving ports 38 along the side walls 14. Each one of the discharge ports 42 is respectively connected to one of the receiving ports 38 through a corresponding discharge duct 50 and discharge port 52, thereby directing the cooler temperature airflow 28 through the housing 12 and into the oven 10.

Airflow regulators 54 can vary the amount of the cooler temperature airflow 28 entering the receiving ports 38. Examples of common airflow regulators 54 include dampers, louvers, flaps, or doors, and may be located within the discharge ducts 50, discharge ports 52, or the receiving ports 38.

Figure 7:
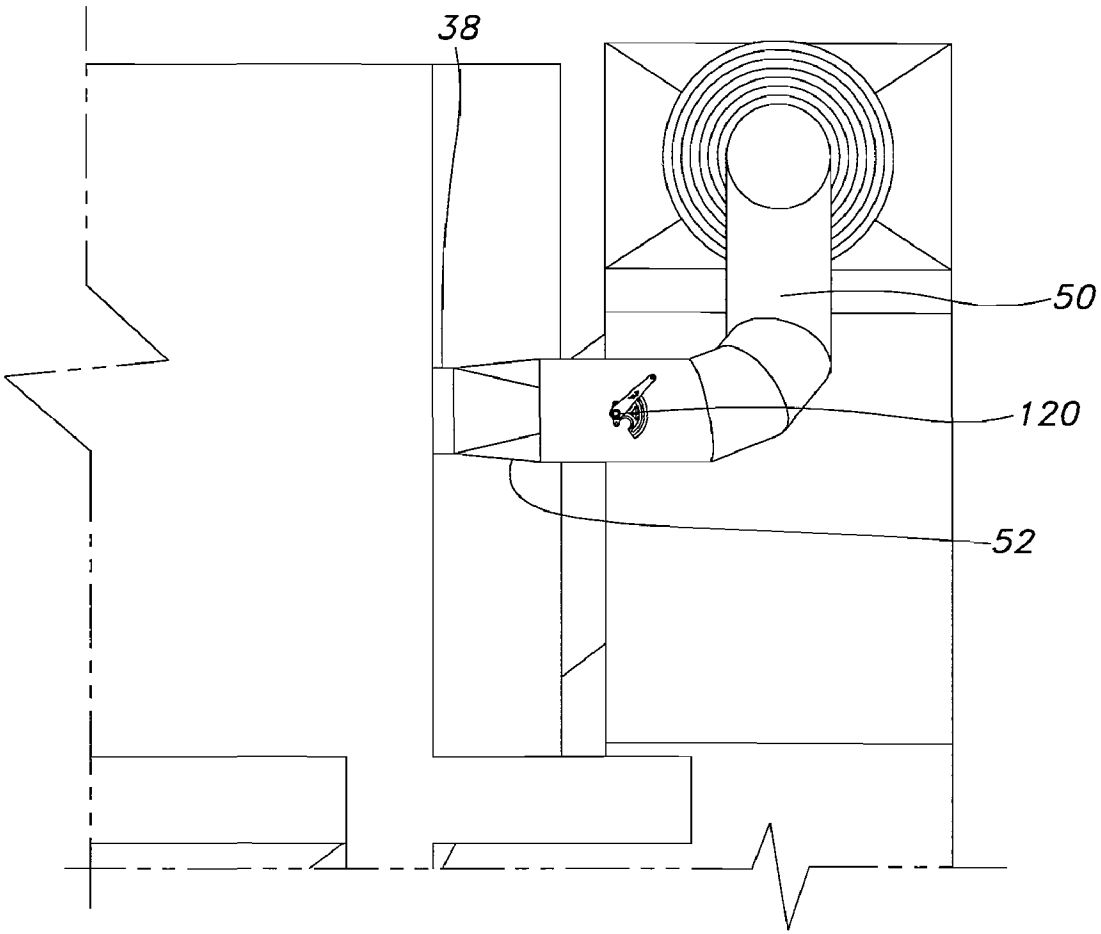
FIG. 7 illustrates the manifold discharge port.
Figure 8:
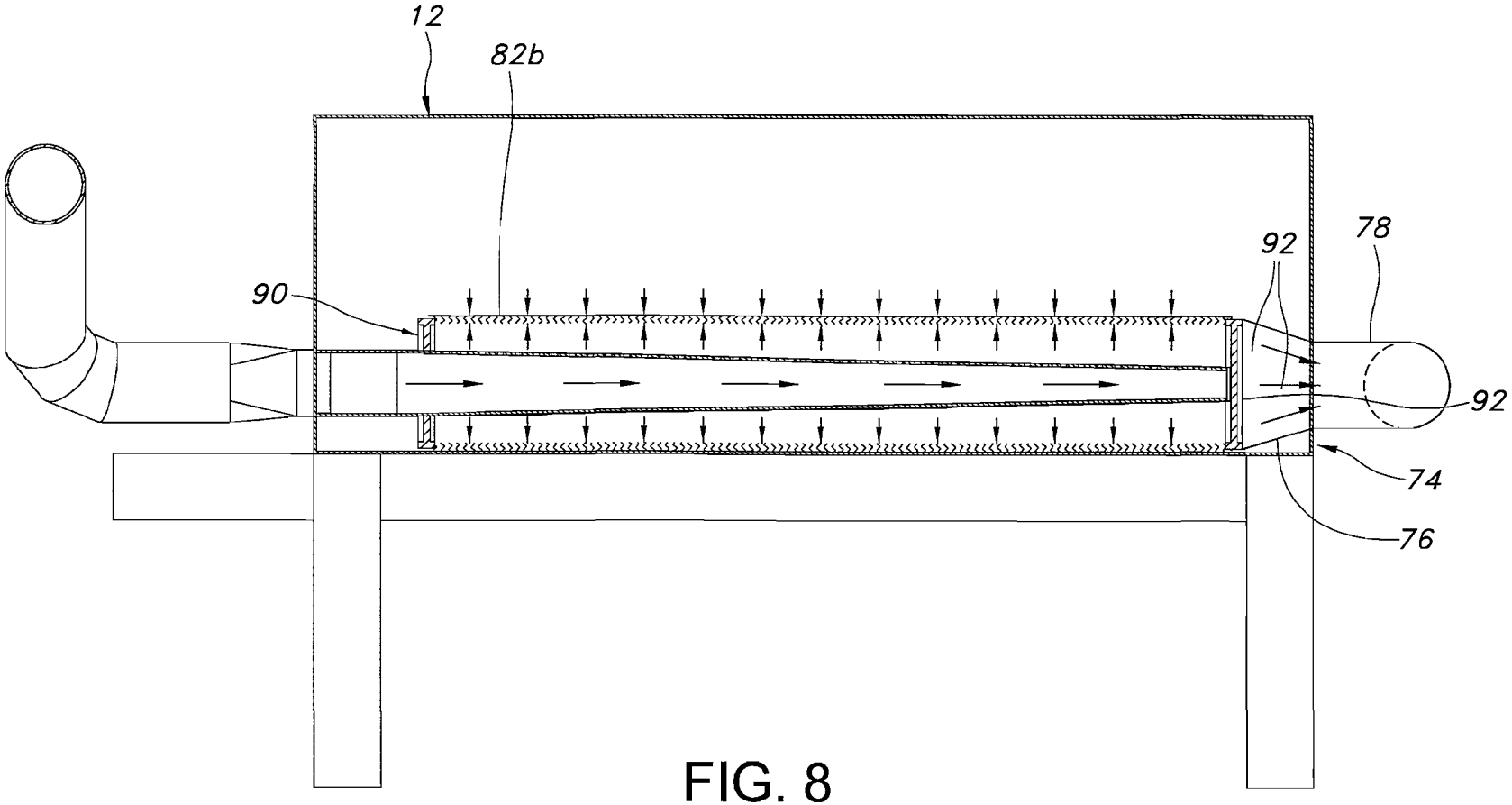
FIG. 8 illustrates an alternative embodiment of the oven.

The airflow regulators 54 may be operated by a controller 120, such as a lever, switch, control knob or similar control means. Preferably the controller 120 is located on the exterior of the discharge duct 50 or the discharge port 52, as particularly shown in FIG. 7.

Figure 5:
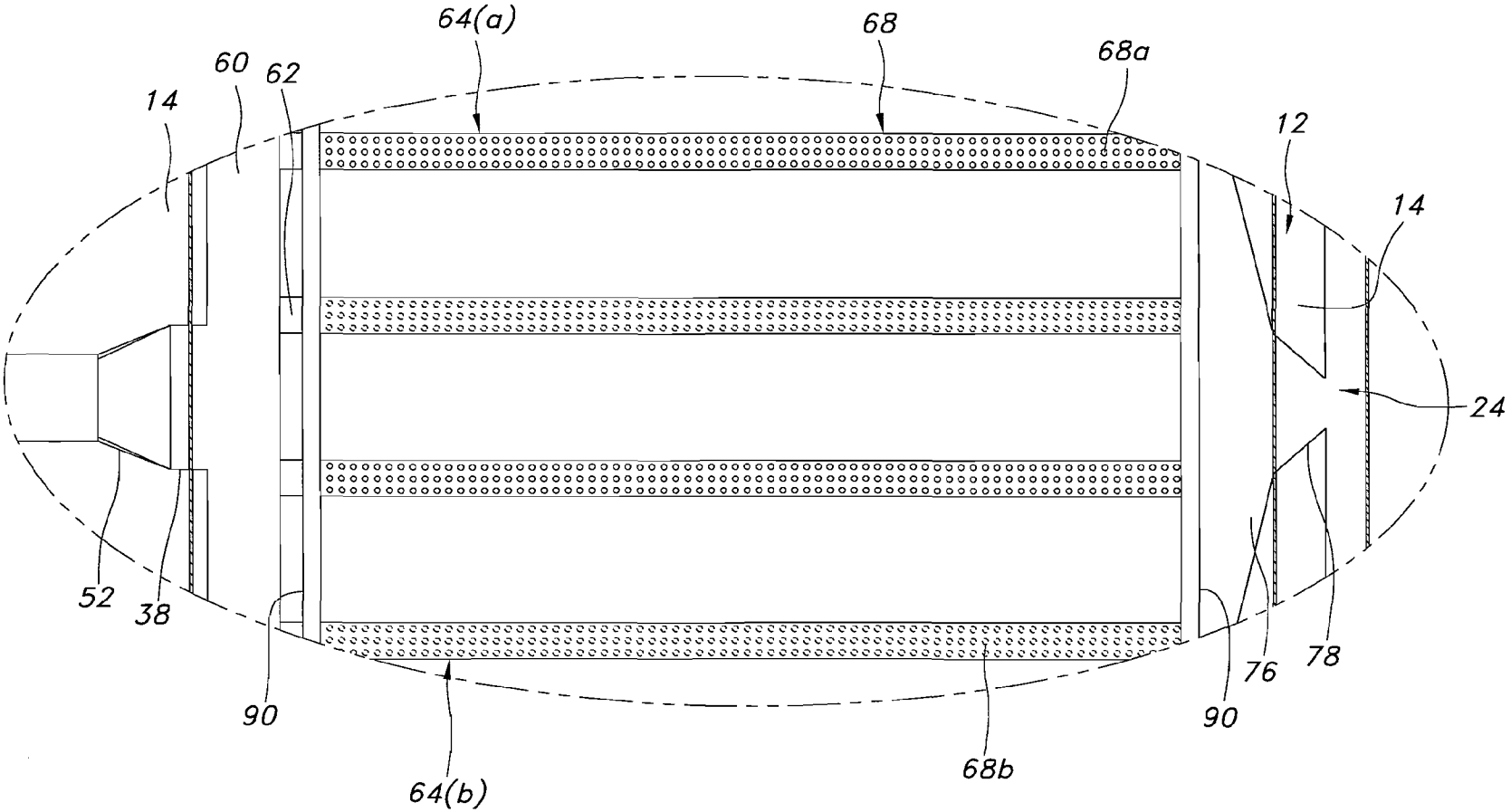
FIG. 5 illustrates a detail view of a cool air duct within the oven.
Figure 6:
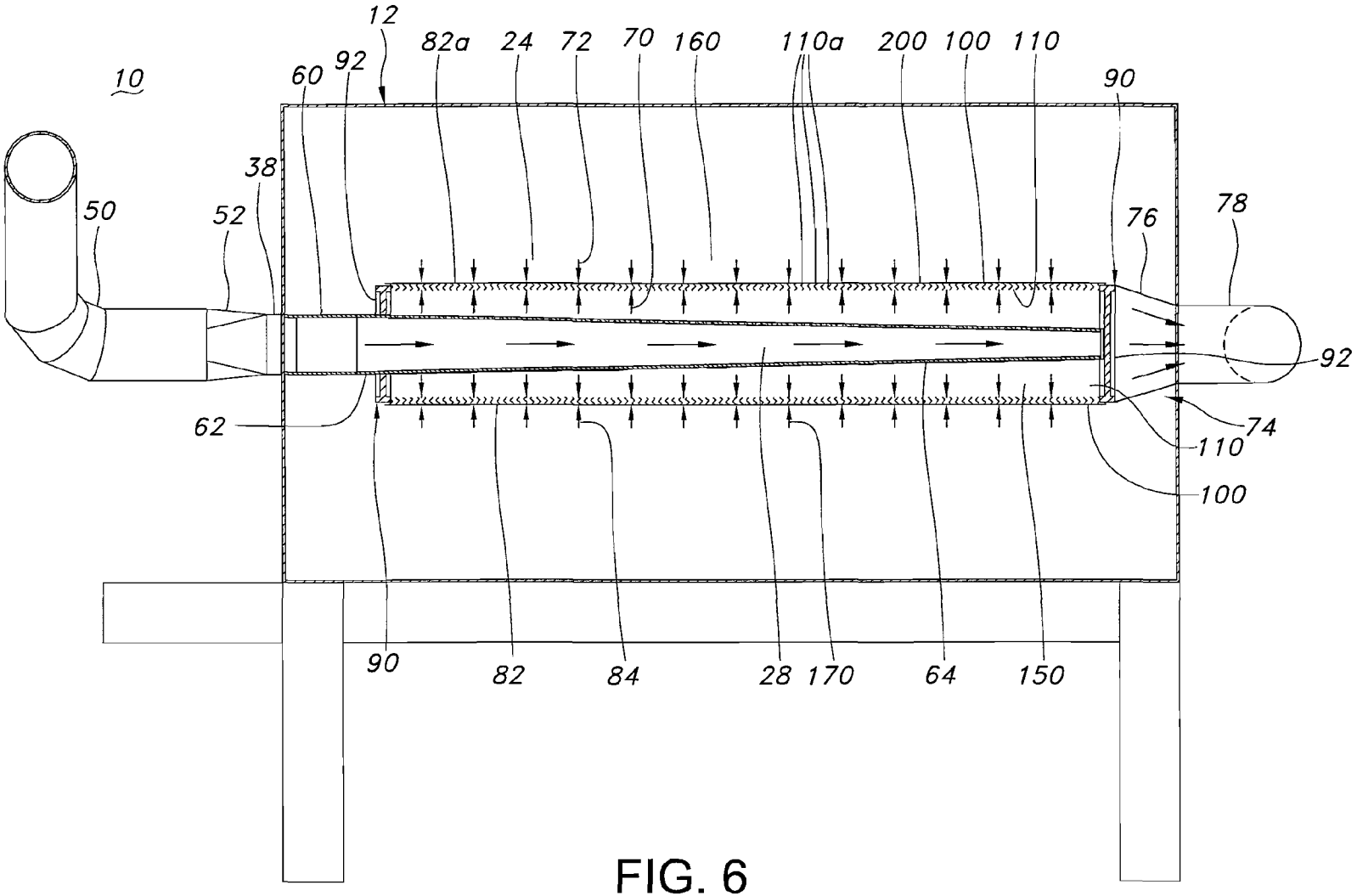
FIG. 6 illustrates a cross sectional view of the oven.

As shown in FIGS. 3-6, the receiving ports 38 are connected to a plurality of distributing plenums 60 within the housing 12 of the oven 10. The distributing plenums 60 have a plurality of distributing ports 62 that distribute cooler temperature airflow 28 from the distributing plenums 60 to a plurality of dispersion ducts 64. The dispersion ducts 64 extend substantially across the width of the oven. Preferably, the dispersion ducts 64 gradually decrease in diameter as the duct extends distal to the receiving port 38, as shown in FIG. 6, facilitating a relatively constant air pressure within the dispersion ducts 64 across the width of oven.

As particularly shown in FIG. 5, the dispersion ducts 64 have a plurality of dispersion orifices 68 of a shape suitable for dispersing cooler temperature airflow 28 to a cooling zone 150 within the oven 10. The possible shapes of the dispersion orifices 68 include circular, elliptical, rectangular, square, or any other shape, such as that described in U.S. Pat. No. 6,933,473. The dispersion orifices 68 may be connected to additional dispersion means, such as nozzles or louvers to direct a stream or jet of air. The dispersion ducts 64 have a top side and a bottom side, and the dispersion orifices 68 may be located on the top, on the bottom, or on both the top and bottom of a given dispersion duct 64, such that the cooler temperature airflow 28 exits from a particular dispersion duct 64 upwardly, downwardly, or in both directions. Preferably, the dispersion orifices 68 direct the cooler temperature airflow 28 in a direction that is aimed directly toward the pile surface 110 of the textile article 200 as it passes through the oven 10.

Figure 2:
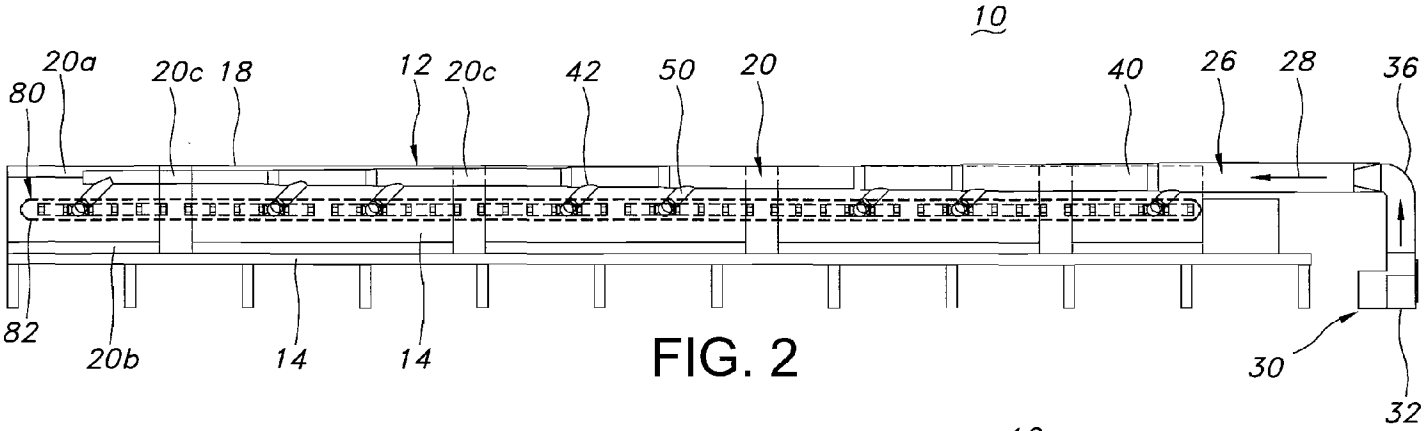
FIG. 2 illustrates a side view of the oven.
Figure 3:
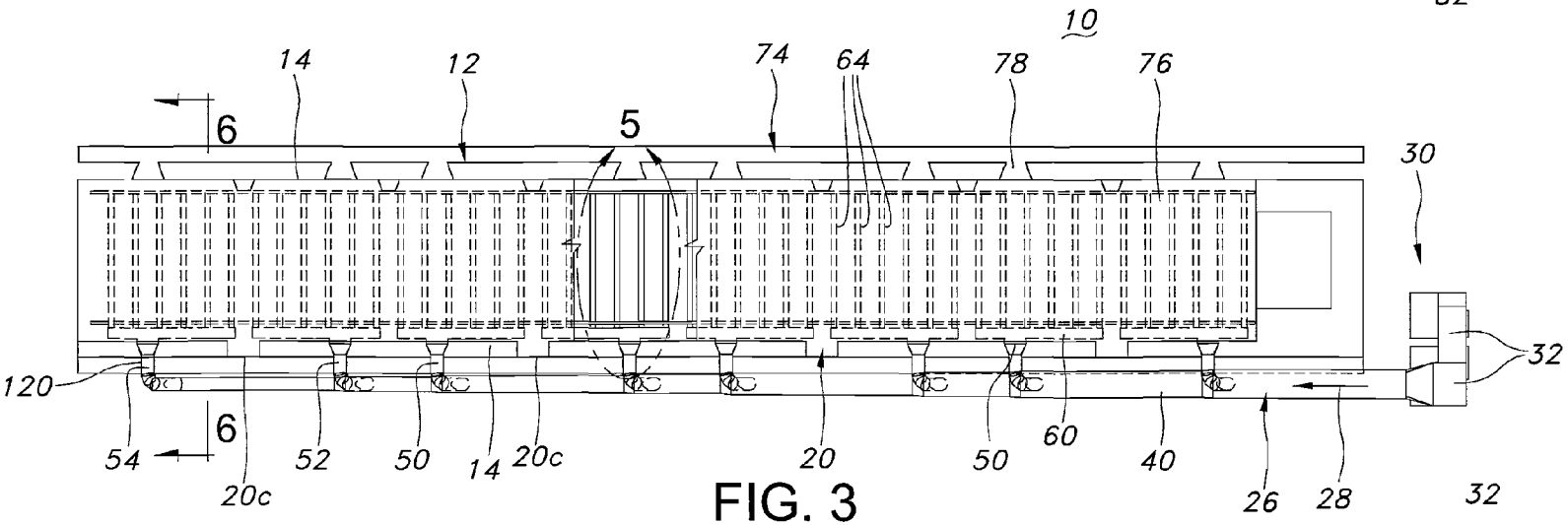
FIG. 3 illustrates a top view of the oven.
Figure 4:
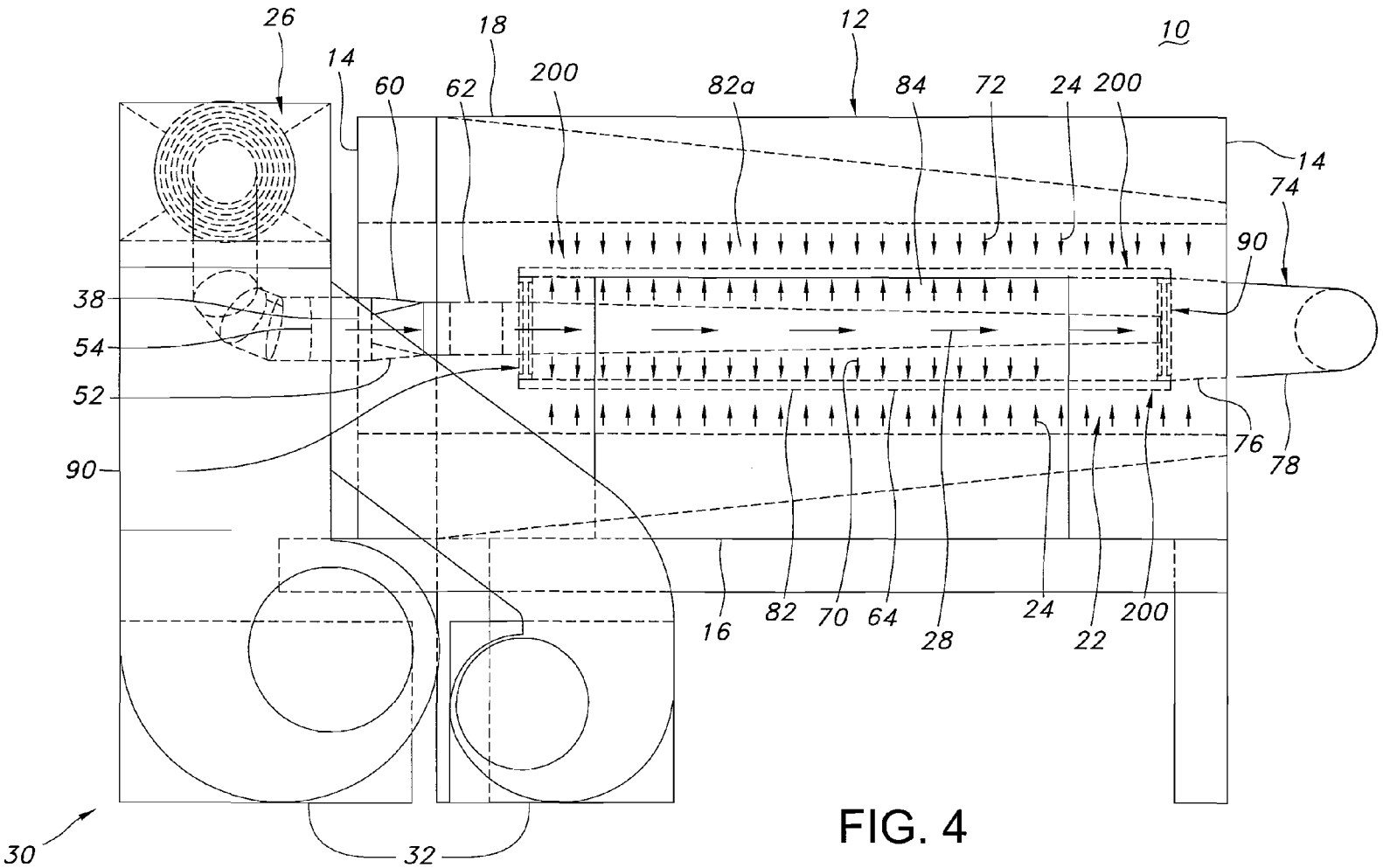
FIG. 4 illustrates a front view of the oven.

The oven 10 has a transport frame 80 for transporting and supporting the textile article 200. The transport frame 80 can be any standard transport and support assembly generally used in textile curing ovens, i.e. the continuous loop flexible chain linkages having the tenter chain with pins, although it should also be appreciated that any mechanism suitable for transporting and supporting an article through the oven 10 could be used for the present invention. In a preferred embodiment, as shown in FIG. 2, transport frame 80 supports the textile article 200 in a double-pass loop 82*a* through the oven 10. As shown in FIG. 6 (transport and support assemblies have been omitted for ease of viewing), the pile surface 110 of the textile article 200 is placed on the transport frame 80 such that it faces the top and bottom sides of the dispersion duct 64. Generally, the double-pass loop 82*a* of the textile article 200 has an interior 84 with the adhesive coated back surface 100 facing outwardly and the opposing pile surface 110 facing inwardly. With this double-pass loop 82*a* configuration, the pile surface 110 into the interior 84 of the double-pass loop 82*a* and surrounds the dispersion duct 64 so it is preferable to have upwardly facing dispersion ducts 64*a* alternating with downwardly facing dispersion ducts 64*b* to more evenly supply the cooler temperature airflow 28 to the pile surface 110. In an alternative embodiment shown in FIG. 8, the oven 10 is a single pass configuration 82*b* which passes straight through the housing 12 on the transport frame 80 without forming any loop.

A plurality of partitions 90 are provided to further separate the cooling zone 150 from the curing chamber 22 within the oven 10. Preferably, the partitions 90 are a metal plate, although they may also be made out of a heat-resistant cloth, an insulating material, or a combination thereof. It will be appreciated that in addition to an airflow barrier 92, the partitions 90 are also formed by the textile article 200 itself and possibly portions of the transport frame 80. For example, in the double-pass loop 82*a* configuration, the partitions 90 include airflow barriers 92 that extend substantially perpendicular with the transport frame 80 in combination with the double-pass loop 82*a* of the textile article 200. The airflow barrier 92 is preferably stationary, being attached to a non-moving part of the transport frame 80 and/or the housing 12. In this configuration, the dispersion duct 64 extends through the partition 90 at the airflow barrier 92 portion proximal to the receiving port 38 and terminates at the airflow barrier 92 portion distal to the receiving port 38. In the single-pass configuration 82*b*, the airflow barrier 92 on the venting side of the housing (discussed below) extends horizontally, from the edges of the textile article 200 on the transport frame 80 to the side walls 14 of the housing 12.

In the preferred embodiment, the double-pass loop 82*a* essentially divides the curing chamber 22 into an upper curing chamber 160 and a lower curing chamber 170. Accordingly, to satisfactorily heat both sections of the curing chamber 22, the heat ducts 20 preferably are divided into upper heat ducts 20*a* above the transport frame 80 that supply the elevated temperature airflow 24 to the upper curing chamber 160 and lower heat ducts 20*b* below the transport frame 80 that supply the elevated temperature airflow 24 to the lower curing chamber 170. The heat ducts 20 preferably also include recirculation ducts 20*c* that return the hot air back to the burner.

In operation, the back surface 100 of the textile article 200 is coated with a thermosetting adhesive and passed through the oven 10 with the pile surface 110 exposed to the cooling zone 150 while the adhesive coated back surface 100 is simultaneously exposed to the curing chamber 22, for a sufficient time and at a sufficient heated zone temperature to soften or melt the adhesive and bond the adhesive to the primary backing and the fibers. Additional secondary, tertiary and further layers of backing materials may also be bound to the textile article 200 in a similar fashion. The cooling zone 150 is pressurized to prevent leakage of heated air from the curing chamber 22 into the cooling zone 150. To pressurize the cooling zone 150 and thereby protect the pile surface 110, the blower 32 draws ambient room air or refrigerated air into the receiving plenum 36 and forces the cooler temperature airflow 28 into the manifold duct 40 through the intake port 34. The cooler temperature airflow 28 enters the discharge ports 42 and respective distribution ducts 50 from the manifold duct 40, and then flows through the distribution ports 52 and sequentially into the receiving ports 38, the distributing plenum 60, the distributing ports 62, the dispersion ducts 64, where the cooler temperature airflow 28 is released inside the oven housing 12 through the dispersion orifices 68, flowing onto and cooling the pile surface 110 of the textile article 200.

Preferably, the dispersion ducts 64 provide the cooler temperature airflow 28 to the cooling zone 150 at a pressure 70 that is greater than the ambient pressure 72 of the elevated temperature airflow 24 in the curing chamber 22. Since the cooling zone 150 is not sealed or completely separated from the curing chamber 22, the greater pressure of the cooler temperature airflow 28 prevents leakage of heated air into the cooling zone 150. Therefore, whereas currently known curing ovens permitted heat to flow through the textile article or partitions which would damage the pile surface, the increased pressure 70 in the cooling zone 150 ensures that any leakage of air through the textile article 200 or partitions 90 is the cooler temperature airflow 28 leaking from the cooling zone 150 into the curing chamber 22, thereby protecting the pile surface 110 of the textile article 200.

The oven 10 can recirculate the air in the curing chamber 22 as is currently done in prior art devices. However, as described above, the oven 10 of the present invention provides active cooling with a positive pressure differential from the cooling zone 150 to the curing chamber 22 (pressure 70>ambient pressure 72). Additionally, in maintaining a constant positive pressure differential, the oven 10 includes egress vents 74 for the cooling zone 150 so that the cooler temperature airflow 28 is vented out of the oven 10. In particular, the egress vents 74 include exhaust ducts 76 which direct the cooler temperature airflow 28 in the plenum of the cooling zone 150 out of the housing 12 to exhaust ports 78, thereby directly venting the cooler temperature airflow 28 from the cooling zone 150 to the exterior of the oven 10 without any recirculation within the oven 10. The airflow barriers 92 on the venting side of the oven 10 isolate the airflow 28 away from the curing chamber 22 while permitting the airflow 28 to pass into the egress vents 74 and out of the housing 12. The cooler temperature airflow 28 is directly passed through the cooling zone 150 and out of the oven 10 to avoid the heat gain that would occur if the airflow were recirculated within the oven 10. To avoid recirculation, or an increase in the ambient temperature of the air source 30, the exhausted airflow may also be ducted away from the blower 32 and may even be ducted out of the building that houses the oven 10.

To evaluate the ability of the oven to cure the adhesives to the back side of the textile article without damaging the pile side, the pile's yarn length (A) is measured before entering the oven, and the textile is then heated in the oven for six (6) minutes after which the length of the pile's yarn length (B) is again measured. The effective shrinkage is quantified according to the Shrinkage Equation below.

$$\text{Shrinkage (\%)}=(A-B)/A\times 100\% \qquad \text{[Shrinkage Equation]}$$

For polyethylene fibers, shrinkage increases with increasing temperatures according to the table below. Generally, the fibers 110*a* in a pile surface 110 are going to experience shrinkage if the temperature on the pile side of the textile article 200 is not actively cooled. Processing a textile article 200, such as greige goods, through the oven 10 of the present invention yields a cured textile article 200 having less than 1% shrinkage (i.e., less than 1/64"). During processing according to the present invention, the oven 10 can maintain a temperature of greater than 194° F. (90° C.) in the curing chamber 22 while the cooling zone 150 is simultaneously maintained at a temperature of approximately 140° F. (60° C.). In a preferred embodiment, the cooler temperature airflow 28 is delivered at a pressure and temperature such that the cooling zone 150 is maintained a temperature equal to or less than 150° F. (65.5° C.) while the curing chamber 22 is maintained at 220° F. (104.4° C.). As discussed above, the cooler temperature airflow 28 is preferably ambient air, or may be cooled but is not passed through any heater, and is vented without any recirculation.

Shrinkage Table for Polyethylene Fiber

| Temperature (° F.) | Shrinkage (%) |
|---|---|
| 158 | 1.2 |
| 176 | 2.4 |
| 194 | 3.5 |
| 212 | 5.3 |
| 216 | 8.0 |
| 230 | 15.1 |

The textile articles 200 produced by the present invention have improved characteristics over those products made using prior art devices and corresponding methods of operation. For example, since the back surface 100 is able to be heated to a higher temperature than in the prior art ovens, and without damaging the pile surface 110 because of the active cooling, the back surface 100 has a stronger tuft lock. Additionally, the pile surface has reduced shrinkage, and virtually eliminated any curling and other heat-related damage to the fibers. In a preferred embodiment, the fibers of the textile article are made of Thiolon® Polyethylene fibers, a polyurethane thermosetting adhesive is used, and the primary backing is a polyolefin scrim material.

All patents and patent application publications referred to herein are incorporated herein. Various coating and laminating ovens are well known in the art, are commercially available and may be modified as described herein to provide the objects and features of the present invention. As various modifications may be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims and their equivalents. Generally, the present invention separates the curing oven into at least two sections that are provided with air of differing temperatures and pressures to create a heated zone, supplied with heated air, and a cooled zone, supplied with ambient air or chilled air.

What is claimed is:

1. An oven for simultaneously heating a back surface of a textile article and cooling an opposing pile surface of the textile article, comprising:

a housing having a curing chamber which heats the back surface of the textile article to an elevated temperature;

a duct system extending through said housing and terminating in a plurality of dispersion orifices proximate to the opposing pile surface with a plurality of egress vents;

an air supply with a temperature less than said elevated temperature, said air supply flowing through said duct system to the opposing pile surface of the textile article opposite said curing chamber and flowing out of said housing through said egress vents; and a partition separating said curing chamber from said dispersion orifices, wherein said curing chamber further comprises a plurality of heat ducts and recirculation ducts and wherein said egress vents comprise a plurality of exhaust ducts, said air supply flows out of said housing through said exhaust ducts without any recirculation back into said housing.

2. The oven set forth in claim 1, wherein said partition is comprised of the textile article on a transport frame and an airflow barrier.

3. The oven set forth in claim 2, wherein the textile article is selected from the group consisting of a synthetic turf and a carpet, and wherein the pile surface comprises a plurality of fibers with a shrinkage of less than 2%.

4. The oven set forth claim 2, wherein said transport frame supports the textile article in at least one of a single-pass loop and a double-pass loop within said housing, wherein the pile surface faces toward said dispersion orifices in said single-pass loop and wherein the opposing pile surface faces inwardly to an interior of said double-pass loop and the back surface faces outwardly away from said interior of said double-pass loop.

5. The oven set forth in claim 4, wherein said partition forms a cooling zone for said air supply apart from said curing chamber, said air supply flowing through said cooling zone having a higher pressure than said curing chamber.

6. The oven set forth in claim 5, wherein said duct system is further comprised of a manifold duct extending along said housing and a plurality of cool air ports extending through said housing and through said partition to a dispersion duct within said cooling zone.

7. The oven set forth in claim 1, wherein said air supply is at a greater pressure than said curing chamber.

8. An oven for heating a back surface of a textile article and simultaneously cooling an opposing pile surface of the textile article, comprising:

a housing having a curing chamber with an elevated temperature and an ambient pressure, wherein the back surface of the textile article is exposed to said curing chamber and the opposing pile surface of the textile article faces away from said curing chamber;

an air supply having a temperature lower than said elevated temperature of said curing chamber and a pressure greater than said ambient pressure of said curing chamber, said air supply providing an airflow; and a duct system extending from said air supply into said housing and terminating proximate to the opposing pile surface of the article, wherein said duct system directs said airflow from said air supply to the opposing pile surface of the textile article while said curing chamber simultaneously heats the back surface of the textile article, and wherein said duct system further comprises a plurality of egress vents wherein said air supply exits said housing; and a partition extending along a length of the textile article.

9. The oven set forth in claim 8, wherein said curing chamber further comprises a plurality of heat ducts and recirculation ducts and wherein said egress vents further comprise a plurality of exhaust ducts, said air supply flows out of said housing through said exhaust ducts without any recirculation back into said housing.

10. The oven set forth in claim 8, wherein said air supply is further comprised of a blower.

11. The oven set forth in claim 8, wherein said duct is further comprised of at least one regulator, a manifold duct extending along said housing and a plurality of cool air ports and wherein each of said cool air ports extends through said housing to a dispersion duct.

12. The oven set forth in claim 11 wherein said dispersion duct is further comprised of a plurality of dispersion orifices.

13. The oven set forth in claim 12, wherein said dispersion orifices aimed toward the pile surface of the textile article and wherein the pile surface comprises a plurality of fibers with a shrinkage of less than 2%.

14. The oven set forth in claim 8, wherein said duct is further comprised of a plurality of cool air ports and wherein each of said cool air ports extends through said housing and said partition to a dispersion duct.

15. The oven set forth in claim 8, wherein said partition is comprised of the textile article on a transport frame and an airflow barrier forming a cooling zone apart from said curing chamber.

16. An oven for heating a back surface of a textile article and simultaneously cooling an opposing pile surface of the textile article, comprising:

a housing;

a transport frame within said housing, said transport frame having a top side and a bottom side;

a plurality of heating elements located above said top side of said transport frame; said heating elements producing an elevated temperature within said housing;

an air supply having a temperature lower than said elevated temperature within said housing;

a duct extending from said air supply into said housing and terminating in a plurality of dispersion orifices below said bottom side of said transport frame;

an egress vent extending from said plurality of dispersion orifices out from said housing; and a partition separating said top side of said transport frame from said bottom side of said transport frame.

17. The oven set forth in claim 16, wherein said partition is comprised of the textile article on said transport frame and an airflow barrier.

18. The oven set forth in claim 16, wherein said partition forms a cooling zone for said air supply within said housing, said air supply flowing through said cooling zone at a higher pressure than said curing chamber.

19. A method for heating a back surface of a textile article and simultaneously cooling an opposing pile surface of the textile article, comprising the steps of:

passing the textile article through a curing chamber in a housing, said curing chamber having an elevated temperature exposed to the back surface;

providing an air supply with a temperature less than said elevated temperature and a pressure greater than in said curing chamber; and directing said air supply to a plurality of dispersion orifices proximate to the opposing pile surface through a duct system, said duct system extending through said housing into a cooling zone.

20. The method set forth in claim 19, further comprising the steps of venting said air supply from said cooling zone and out of said housing without any recirculation and maintaining a pile fiber shrinkage at less than 2%.

* * * * *